US009109828B2

(12) United States Patent
Delgadillo

(10) Patent No.: US 9,109,828 B2
(45) Date of Patent: Aug. 18, 2015

(54) CONVERTIBLE AND COMPACT REFRIGERATION SYSTEM

(76) Inventor: Hector Delgadillo, Duarte, CA (US)

( * ) Notice: Subject to any disclaimer, the term of this patent is extended or adjusted under 35 U.S.C. 154(b) by 363 days.

(21) Appl. No.: 13/541,665

(22) Filed: Jul. 4, 2012

(65) Prior Publication Data

US 2012/0321490 A1 Dec. 20, 2012

Related U.S. Application Data

(63) Continuation-in-part of application No. 13/284,862, filed on Oct. 28, 2011.

(60) Provisional application No. 61/407,572, filed on Oct. 28, 2010.

(51) Int. Cl.
*F25D 17/06* (2006.01)

(52) U.S. Cl.
CPC ..... *F25D 17/067* (2013.01); *F25D 2317/0683* (2013.01)

(58) Field of Classification Search
CPC ..... F25D 17/067; F25D 2317/0683
USPC ..... 62/262, 426
See application file for complete search history.

(56) References Cited

U.S. PATENT DOCUMENTS

| | | | | |
|---|---|---|---|---|
| 3,262,491 | A * | 7/1966 | Selhost | 165/48.1 |
| 3,305,164 | A * | 2/1967 | Laing | 417/350 |
| 3,741,290 | A * | 6/1973 | Nenadal | 165/48.1 |
| 3,874,191 | A * | 4/1975 | Hudson | 62/426 |
| 4,450,755 | A * | 5/1984 | Catan | 454/188 |
| 4,672,819 | A * | 6/1987 | Mino et al. | 62/298 |
| 6,324,859 | B1 * | 12/2001 | Tesche et al. | 62/262 |
| 6,637,232 | B1 * | 10/2003 | Harshberger et al. | 62/285 |
| 6,725,915 | B2 * | 4/2004 | Wheat et al. | 165/299 |
| 6,990,825 | B2 * | 1/2006 | Hansen | 62/285 |
| 6,997,005 | B2 | 2/2006 | Haasis | |
| 2006/0064996 | A1 * | 3/2006 | Violand et al. | 62/186 |
| 2009/0095442 | A1 * | 4/2009 | Wiggs | 165/45 |
| 2010/0215486 | A1 * | 8/2010 | Shirahama | 415/204 |

* cited by examiner

*Primary Examiner* — Emmanuel Duke
(74) *Attorney, Agent, or Firm* — Steven A. Nielsen; www.NielsenPatents.com

(57) ABSTRACT

A refrigeration system comprises a fan and motor unit 575 having a plurality of cross-flow blower wheels 530 or air blower turbines place upon either side of a motor or unique cross flow motor. The fan and motor unit 575 may be attached to either a top plate 550 to create a side discharge or to a back plate 570 to create a top discharge. The top plate 550 comprises a plurality of top discharge vents and a front discharge plate cover 545 comprises a plurality of side discharge vents 546. A technician in the field may configure a disclosed refrigeration system either a side or top discharge by rotating the position of the fan and motor unit.

4 Claims, 21 Drawing Sheets

CONVERTIBLE AND COMPACT REFRIGERATION SYSTEM

CROSS-REFERENCE TO RELATED APPLICATIONS

This is a Continuation in Part utility application based upon U.S. patent application Ser. No. 13/284,862 filed on Oct. 28, 2011 which is a non-provisional application based upon provisional application 61/407,572,512 filed on Oct. 28, 2010. These two related applications are incorporated herein by reference and made a part of this application. If any conflict arises between the disclosure of the invention in this utility application and that in the related applications, the disclosure in this utility application shall govern. Moreover, the inventor(s) incorporate herein by reference any and all patents, patent applications, and other documents hard copy or electronic, cited or referred to in this application or the two related applications.

BACKGROUND OF THE INVENTION (1) Field of the Invention

The invention generally relates to refrigeration systems. More particularly, the invention relates to means and methods of producing a compact and convertible refrigeration unit, easily adapted to direct cooled air in two or more directions.

(2) Description of the Related Art

Other refrigeration systems are known in the related art. For example, U.S. Pat. No. 6,997,005 by Haasis issued on Feb. 14, 2006, discloses a refrigeration system with a sliding sub-unit comprising a centrifugal fan, fan motor, additional fan for cooling the fan motor, a flange and track slider assembly and a collection of springy metal stripes used to secure the sub-unit into a housing unit. Unfortunately, the system disclosed by Haasis leads to added noise and motor vibration due to the use of springy metal strips to secure the sub-unit to the housing. In order to achieve a secure and vibration resistant fit of the sub-unit, silicone or other materials are commonly used within the flange and track slider assembly. When a fan motor needs replacement, the typical service technician will not have the necessary sealants, which results in a newly installed motor causing unacceptable noise and vibration.

Another shortfall in the Haasis system is the inefficiency of using one motor to turn a single traditional centrifugal fan. Moreover, the overall design of the Hassis system requires the use of a second motor cooling fan to cool the motor also turning the centrifugal fan. The added load to the motor from the second cooling fan often creates more heat than what is removed by the second fan. Furthermore, the coil configuration of the Haasis system fails to adapt to varying food storage containers or other applications with untraditional dimensions and access problems. Moreover, the overall configuration of the Haasis system leads to a heavy cooling system making installation difficult in overhead locations.

BRIEF SUMMARY OF THE INVENTION

The present invention overcomes shortfalls in the related art by presenting an unobvious and unique combination and configuration of coils, blowers, a blower motor and other components to provide a compact unit with means of easily redirecting cooled air flow to fit various applications.

One of the main advantages of this invention is the creation of a twin cross flow blower system comprising two air blower turbines placed on either side of a unique cross flow motor. The twin blower turbines are sometimes referred to herein as a "cross flow blower" and are sometimes named "cross flow blower 1" and cross flow blower 2. The placement of a cross flow motor between the two disclosed cross flow blowers has achieved unexpectedly favorable results in efficiently moving cooled air to a targeted area.

The cross flow blowers feature a new and efficient air blade configuration as well as a highly moveable air flow diverter. The moveable air flow diverter allows the disclosed cross flow system to be adapted to many configurations to fit most applications.

The disclosed configuration of a center cross flow motor flanked by two cross flow blowers placed over a compact coil system provides clear advantages over the related art in terms of weight and size.

The disclosed coil systems also provide unexpectedly favorable results as they have been configured to adapt to untraditional locations.

Another advantage of the disclosed embodiments, including a second embodiment is a new fan and motor unit used with a new motor housing, the new motor housing allowing the new fan and motor unit to be easily installed in either a top discharge or side discharge configuration. In the related art, separate units were constructed to accommodate either a top discharge or side discharge application. Workers in the field would need to bring the correct machine for a particular job, or carrier two machines. Thus, the present invention, including the second embodiment presents a significant departure from the prior art.

The second embodiment overcomes shortfalls in the art by presenting a new fan and motor unit having artful fastening clips allowing the fan and motor unit to efficiently attached either of two positions within in the motor housing. The motor housing includes a back plate, fastener voids, two sets of discharge vents and other features not found in the prior art.

These and other objects and advantages will be made apparent when considering the following detailed specification when taken in conjunction with the drawings.

REFERENCE NUMERALS IN THE DRAWINGS

Figure 1:
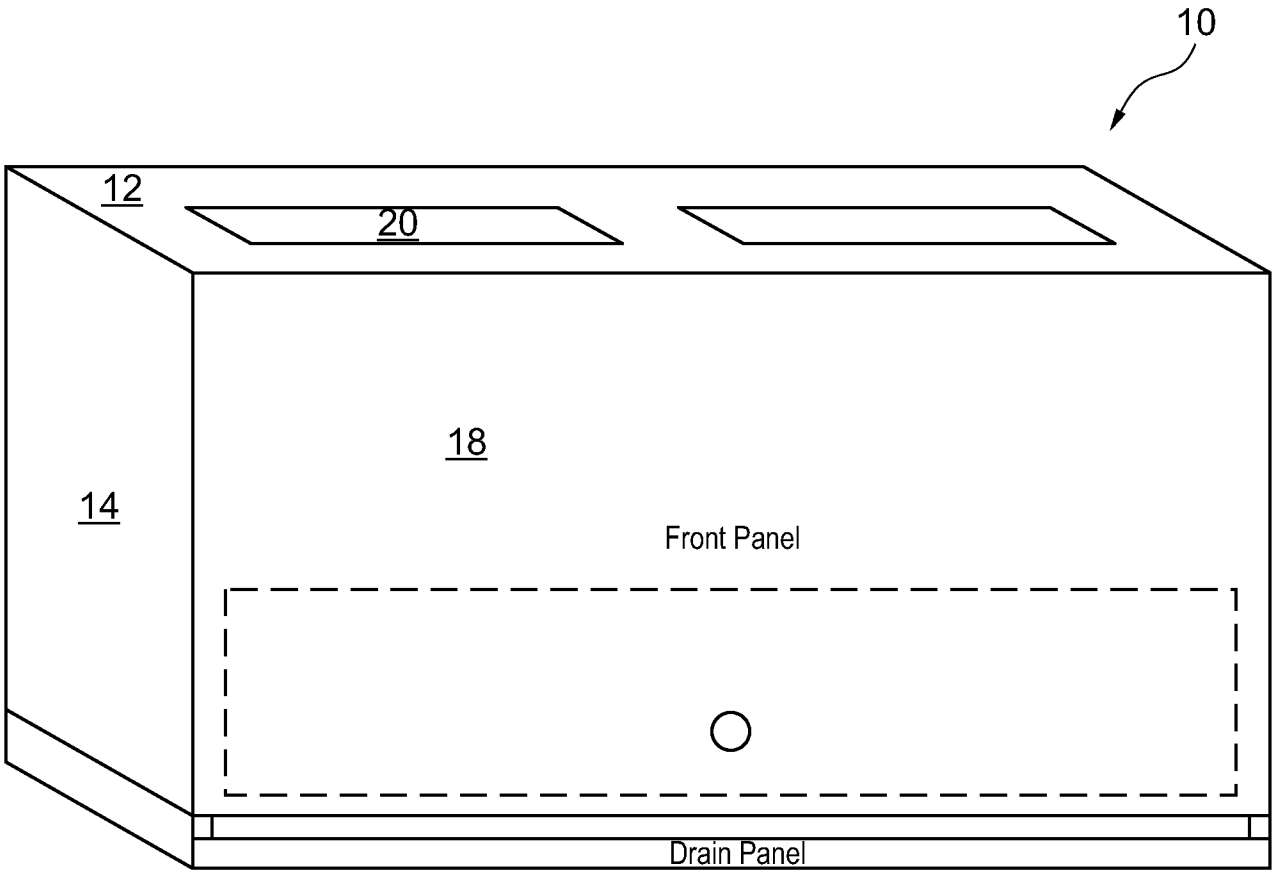
FIG. 1 is a perspective view of a typical food storage container.

10 a typical food storage structure
18 front panel of a food storage structure
12 top panel of a food storage structure
20 void or door window used to access food within a food storage structure
42 thermostat
48 evaporation coils
100 cross flow blower 1
101 bottom of cross flow blower
102 rotational plate on side of cross flow blower, used to attached to cross flow motor
150 cross flow blower 2
300 cross flow motor
400 components of housing assembly of one embodiment of the invention
401 side panel of housing assembly of one embodiment of the invention
402 side sheet of housing assembly of one embodiment of the invention
500 condensation pan
501 a second embodiment sometimes called a "Convertible and Compact Refrigeration System"
510 top plate
515 motor
520 liquid line u bend
TXV valve
530 a cross-flow blower wheel of a second embodiment
535 coated evaporator coil
540 sensing bulb
544 lower housing
545 front discharge plate cover
546 side discharge vents
548 fasteners securing fan and motor unit in a top discharge position
550 top plate of motor housing
551 motor housing
552 fastener voids within top plate 550 of motor housing 551
555 top discharge vents
560 digital control stat
565 power head
570 back plate sometimes used to secure the motor unit in position for top discharge
572 fastener voids of the back plate, shown with fasteners secured within the back plate to secure the motor unit in position for top discharge
575 fan and motor unit
580 fastening clips on fan and motor unit 575
583 fan cover of fan and motor unit 575
584 fan cover voids
585 air flow void of fan cover

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

Referring to FIG. 1 a typical food storage container 10 is shown with a front panel 18, side panel 14, a top panel 12 and voids or doors 20 used to access the interior. Variations of the illustrated food storage container may be found in supermarkets, restaurants and other places requiring the refrigeration of food.

Typically cooling units are placed within the back section of a food storage container introduce evaporator coils carrying a coolant in expanding gas form. As gas expands, the gas cools and absorb heat from the coils, the coils in turn absorb heat from the surrounding air. After absorbing heat, the gas within the coils travels outside of the food storage container. In this outside area, a compressor and condenser transform the gas into liquid form. An outside fan may be used to blow ambient air over the outside coils. On the return route to the food storage container, the liquid within the coil system passes through an expansion value wherein the liquid expands to gas, travels within the food storage container, cools and then transfers heat to the outside of the food storage container.

Figure 2:
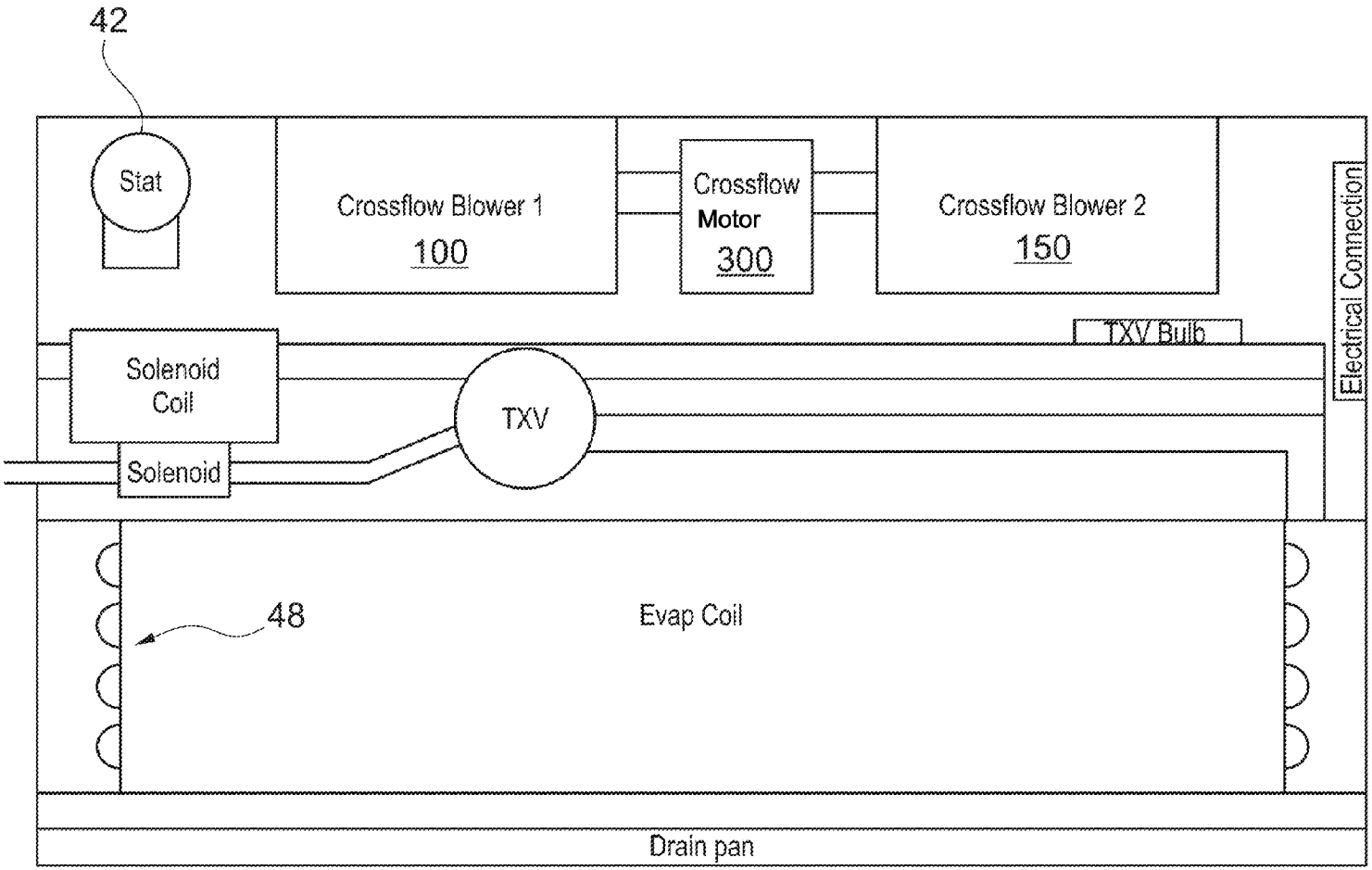
FIG. 2 is a sectional and elevation view of one embodiment of the disclosed invention.

Coils containing gas and found within the food storage container are sometimes called evaporation coils 48 and are shown in FIG. 2 on the bottom of the disclosed system. The disclosed system sits within a food storage container or other application and accepts coolant that is compressed, allows the fluid to expand to gas within the evaporation coils and then outputs the gas to an exterior system as described above.

A key advantage of the disclosed system is the efficient movement of air over the evaporation coils and into the food storage area. Found at the top of FIG. 2 is a disclosed cross flow motor 300 which powers two cross flow blowers 100 and 150. The components of FIG. 2 are arranged such that they fit into a housing that may be approximately 4.5 inches deep, 21.5 inches across and 10 to 12 inches high. But, other dimensions and configurations are contemplated. In the preferred embodiment, all of the components of FIG. 2 are bolted or otherwise firmly attached to the housing.

The use of an extra fan to cool the motor as disclosed in the Haasis system is not needed in the system presented herein. Moreover, in order to achieve a compact size and sturdy construction, the disclosed system does not adopt the configuration of a sub-unit or the use of tracks to install components. Such a cumbersome system of attachment would detract from the compact and lightweight feature of the disclosed system.

Figure 3:
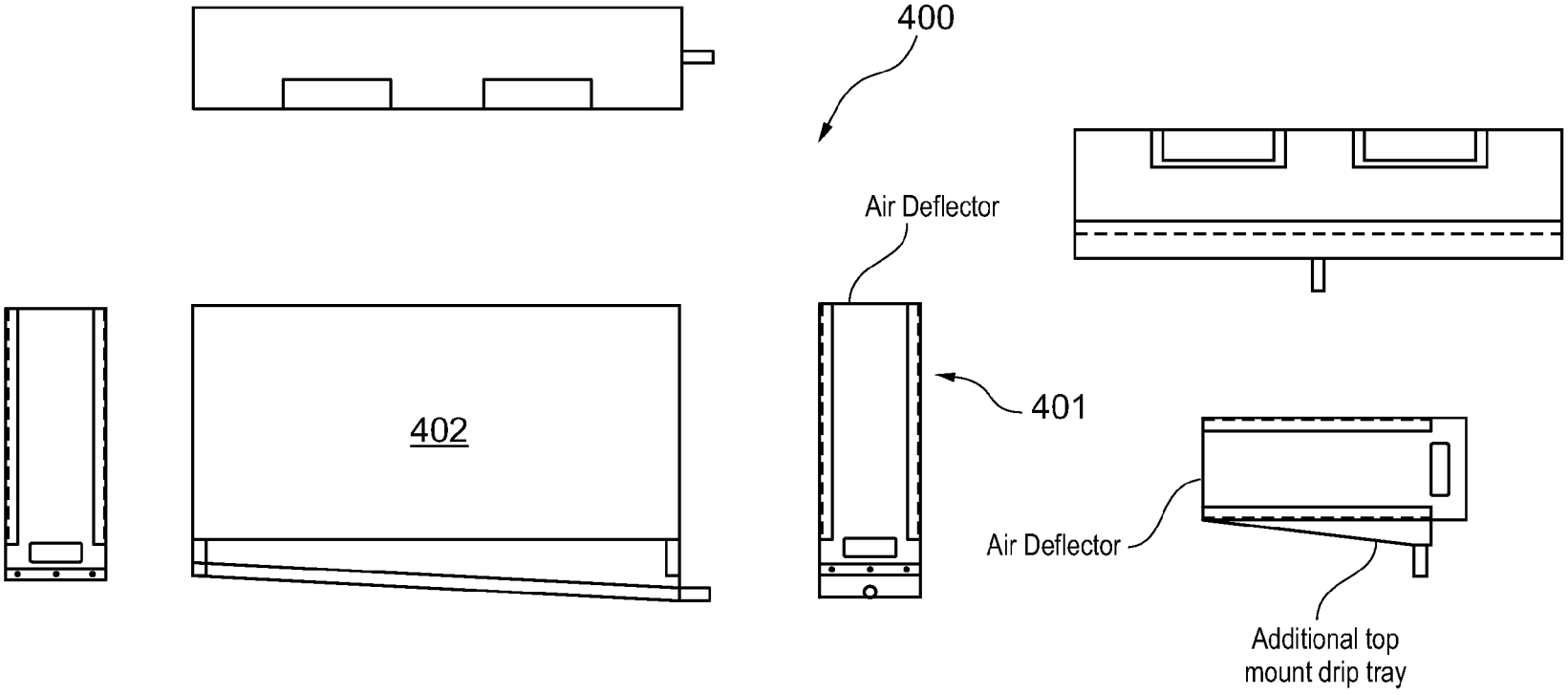
FIG. 3 presents several views of a disclosed housing assembly.

Referring to FIG. 3 the general shapes and contemplated dimensions of the housing assembly 400 are shown. Alternative configurations for the housing assembly are contemplated and do not detract from the benefits of the disclosed system.

Figure 6:
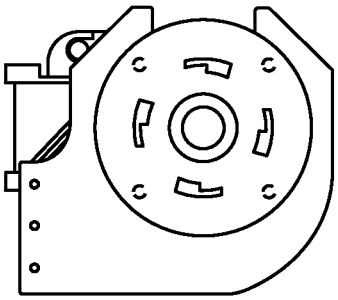
FIG. 6 presents a side view of a disclosed cross flow blower and attachment point to a cross flow motor.
Figure 4:
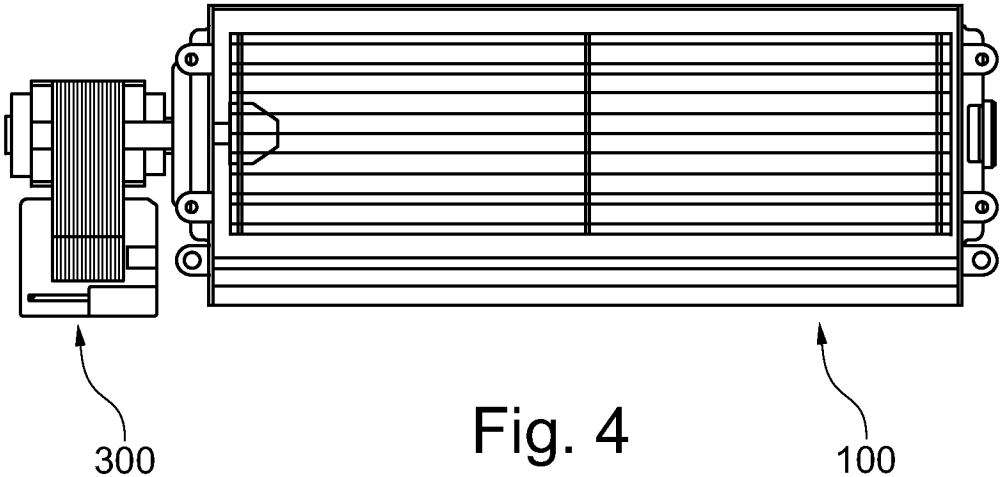
FIG. 4 presents a sectional view of a disclosed cross flow blower.
Figure 5:
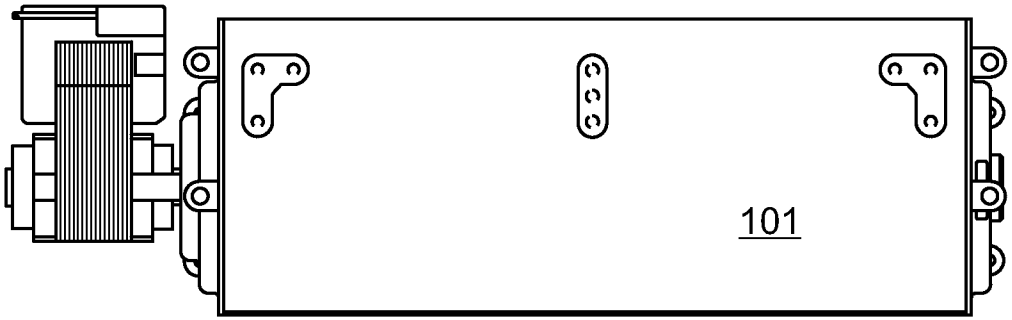
FIG. 5 presents a bottom view of a disclosed cross flow blower.

Referring to FIG. 4 a section view of one embodiment of a cross flow blower 100 is shown as well as an attached cross flow motor 300. FIG. 5 presents a plan view of the bottom side of a cross blower. FIG. 6 presents a side view of a cross flow blower and rotational plate 102 ready for attachment to a cross flow motor 300.

Figure 7:
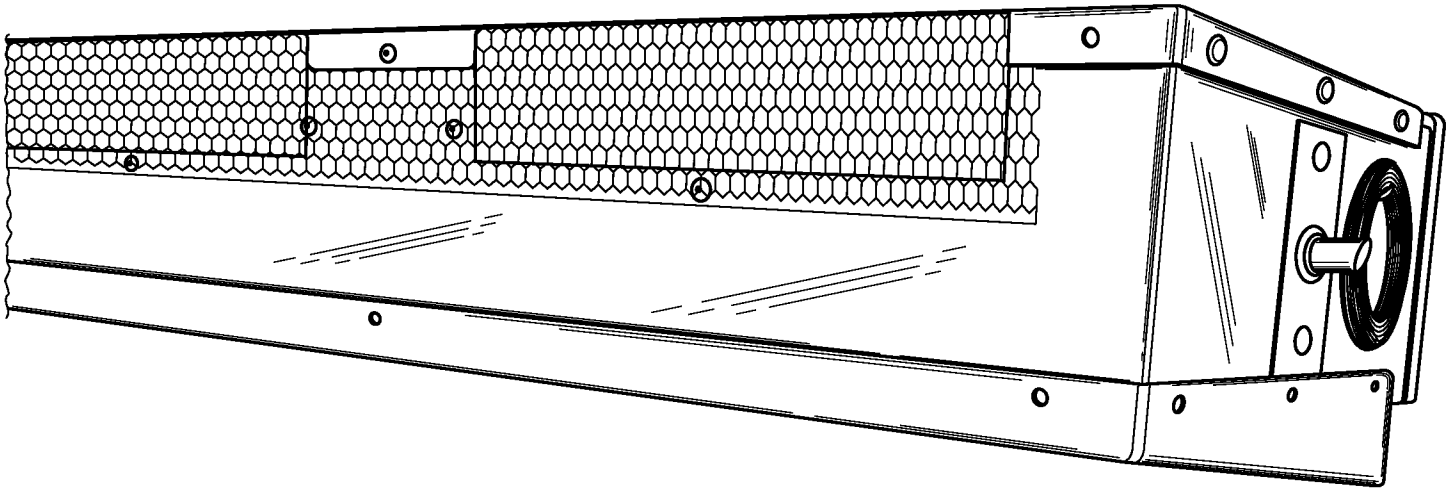
FIG. 7 is a perspective of one embodiment of the invention being held by the fingertips of a person.

FIG. 7 presents a top perspective view of one embodiment of the disclosed invention. The cool air exit vents are covered in mesh and the entire housing assembly is supported by the fingertips of person of average strength.

Figure 8:
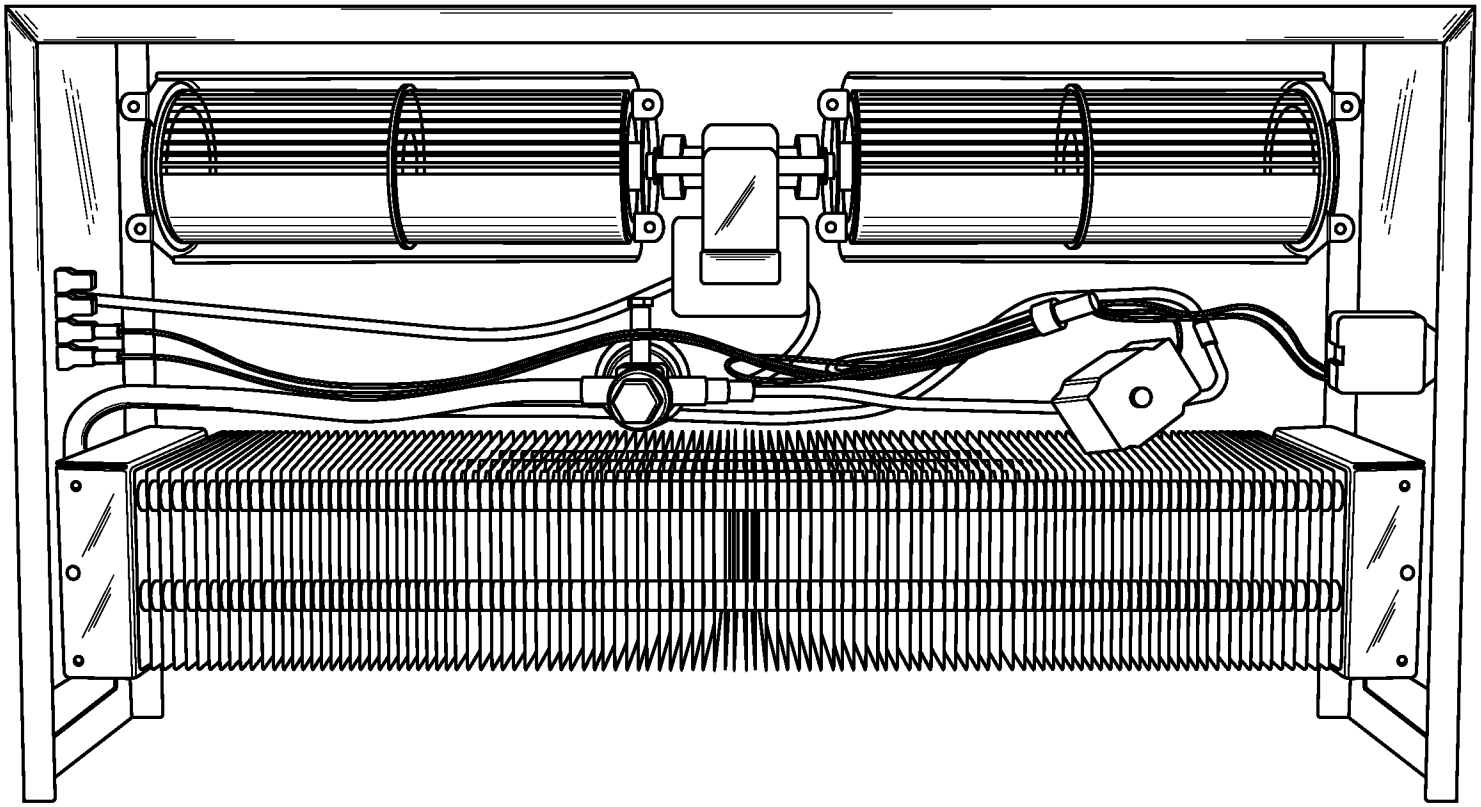
FIG. 8 is an elevation view of one embodiment of the invention.

FIG. 8 illustrates a more detailed view of FIG. 2 and shows a working model of one embodiment of the disclosed invention. FIG. 8 shows a void area at the bottom to allow entry of ambient air that passes through the condenser coils and into the cross flow blowers.

Figure 9:
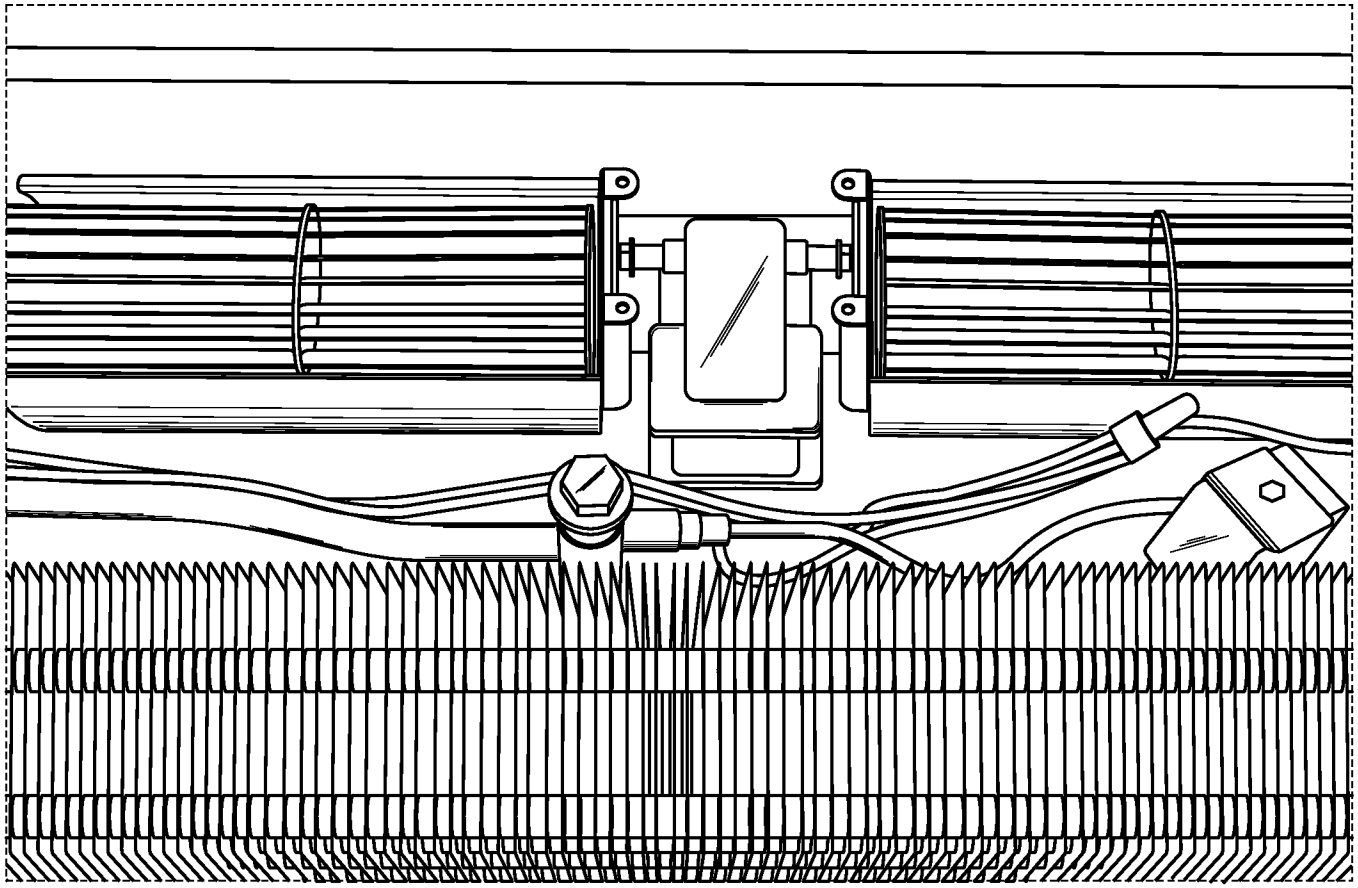
FIG. 9 is an expanded view of FIG. 8.

FIG. 9 presents a close up view of the cross flow motor 300 while attached to both cross flow blowers. The disclosed configuration places the cross flow motor 300 in close proximity to the evaporation coils, thus the extra motor cooling fan of the Haasis system is not needed. Also the surface area and shape of the disclosed cross flow motor provides ample motor cooling with excellent motor performance.

Figure 10:
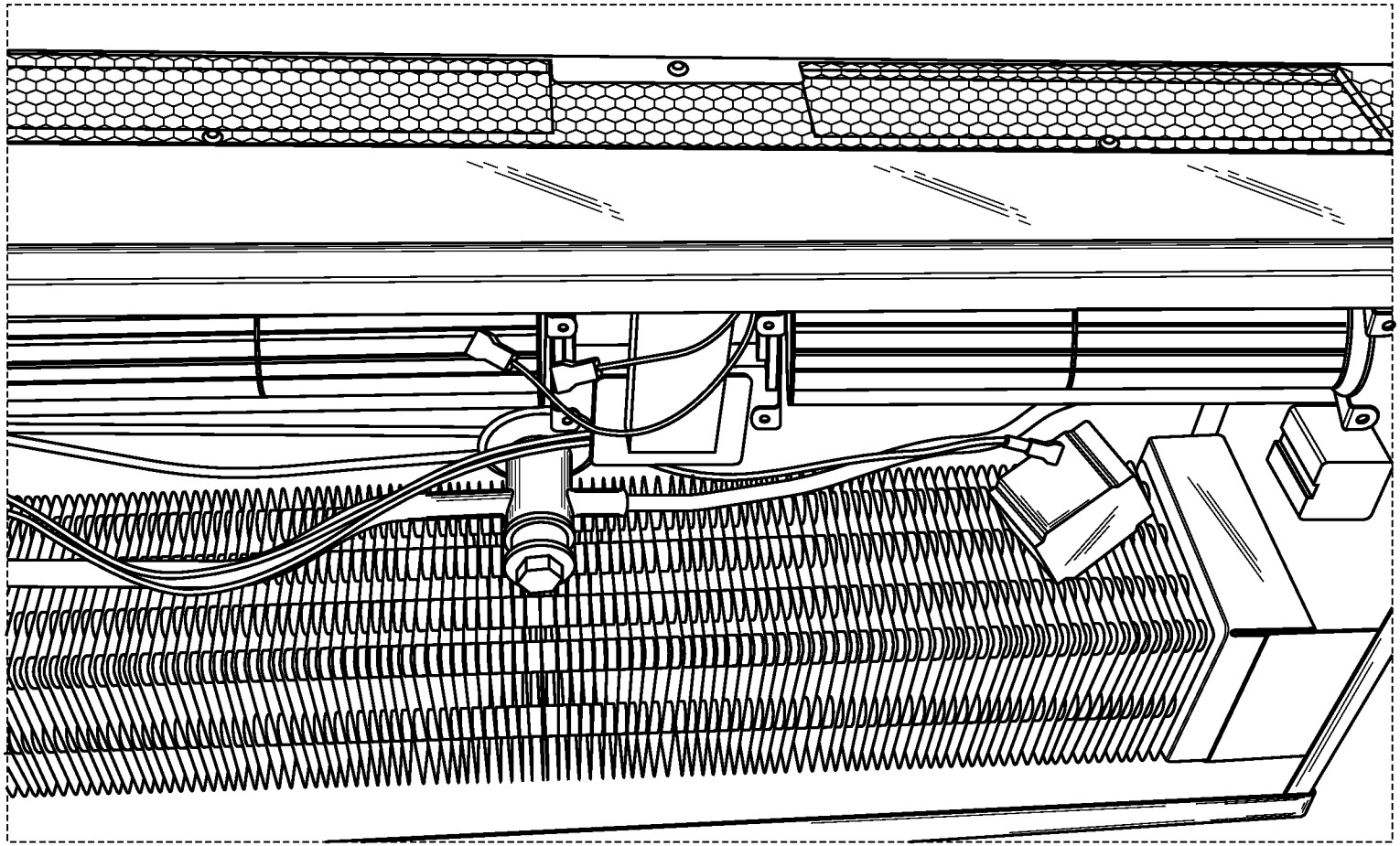
FIG. 10 is a perspective view of the output vents of one embodiment of the invention.
Figure 11:
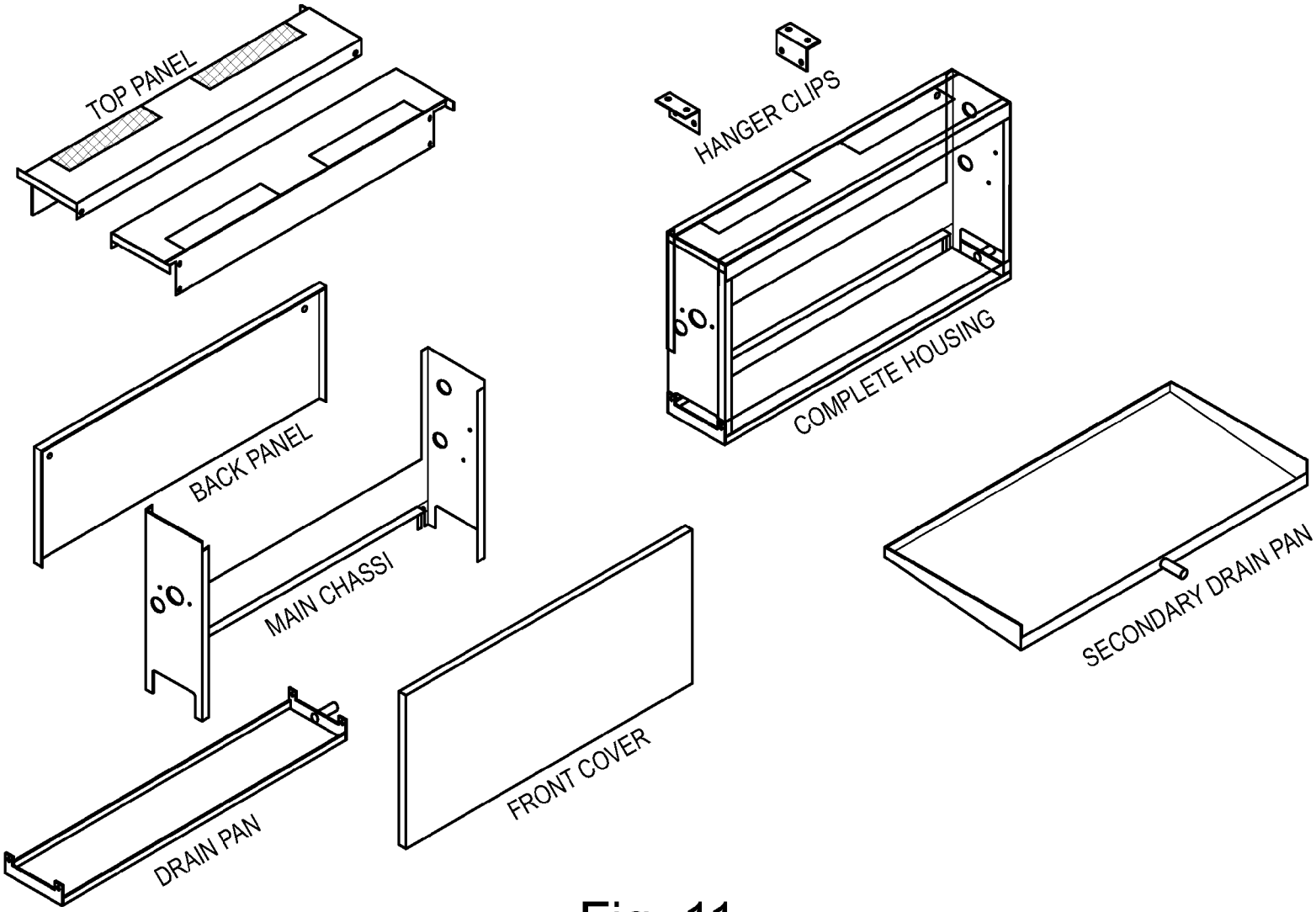
FIG. 11 depicts various parts of one embodiment of the invention.
Figure 12:
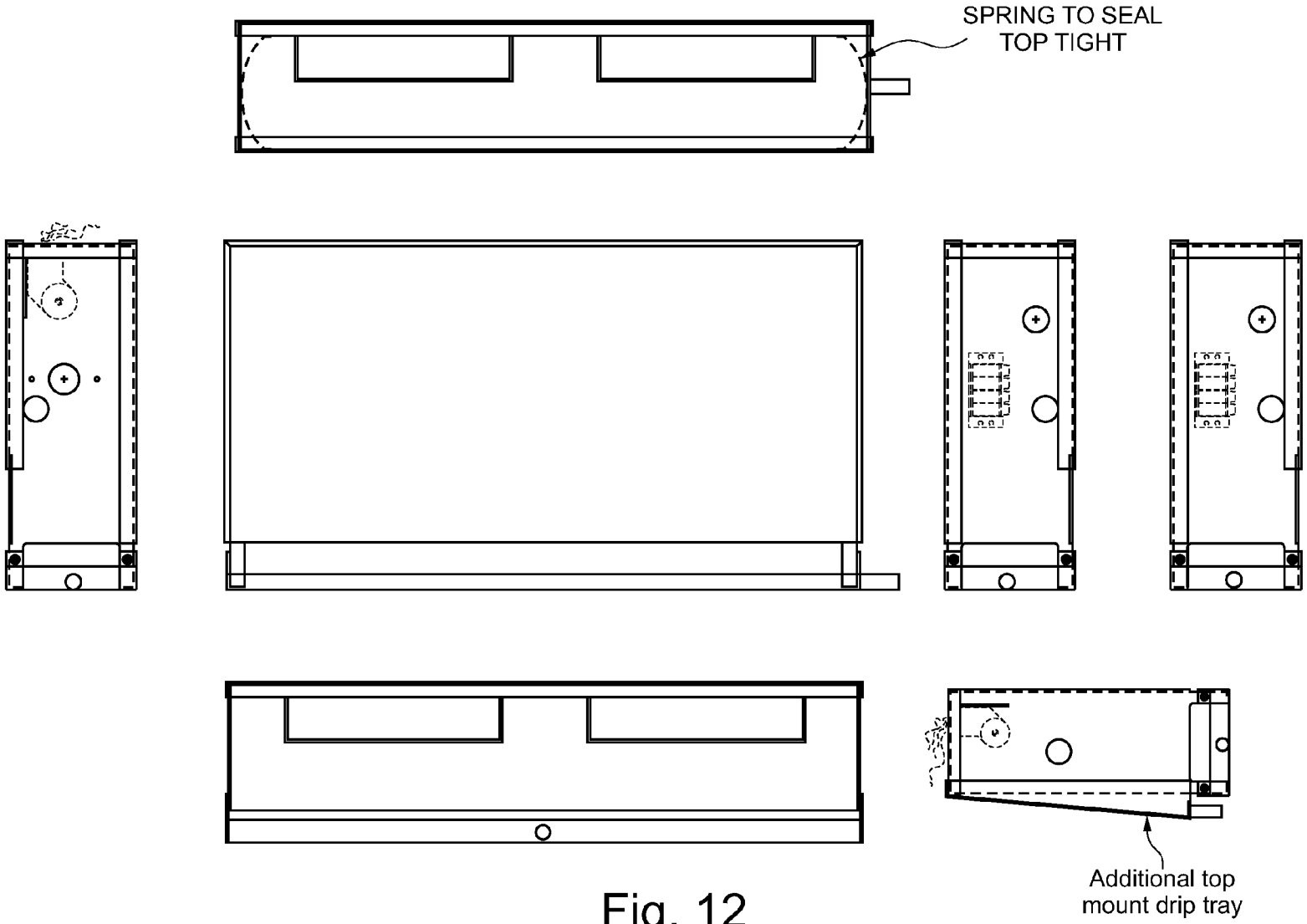
FIG. 12 depicts various parts of one embodiment of the invention.
Figure 13:
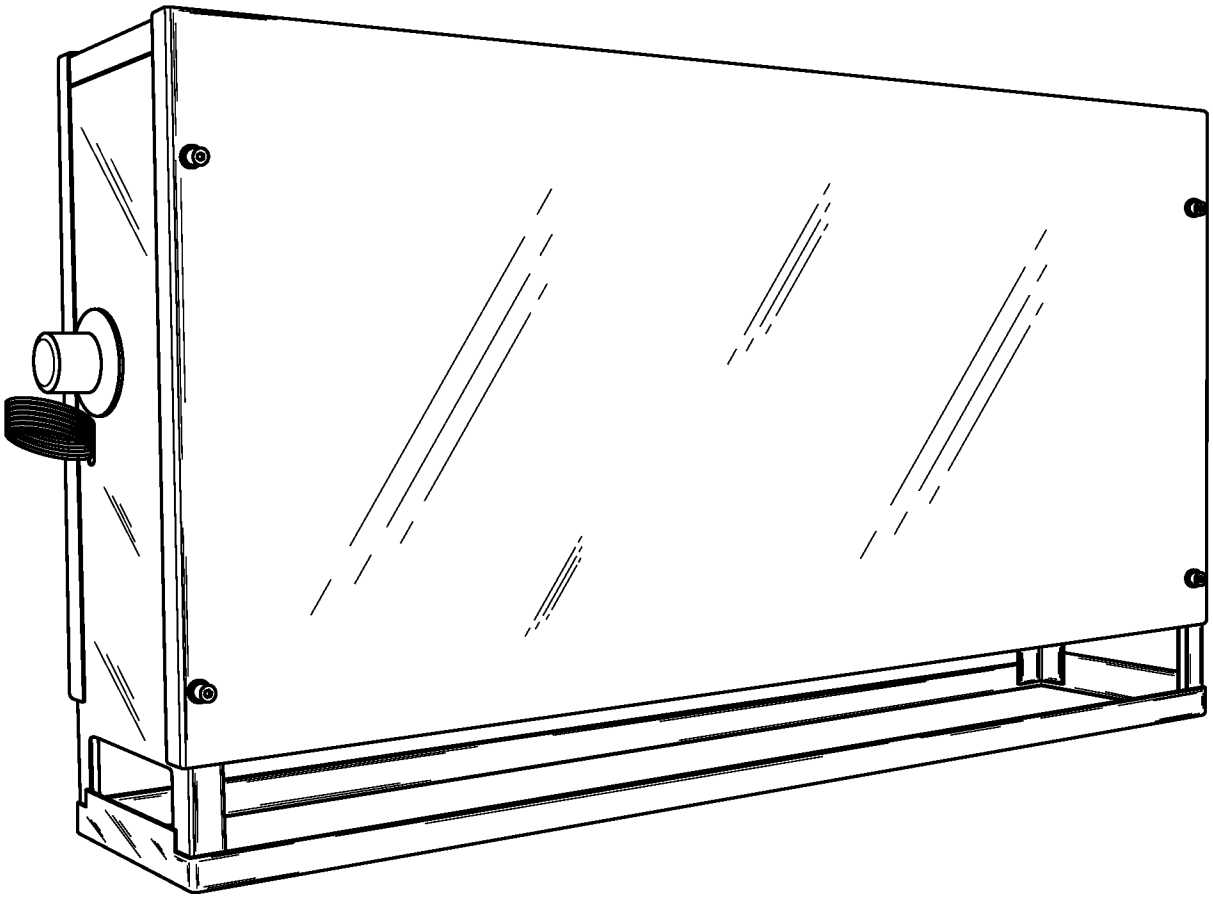
FIG. 13 depicts a front view of one embodiment of the invention.
Figure 14:
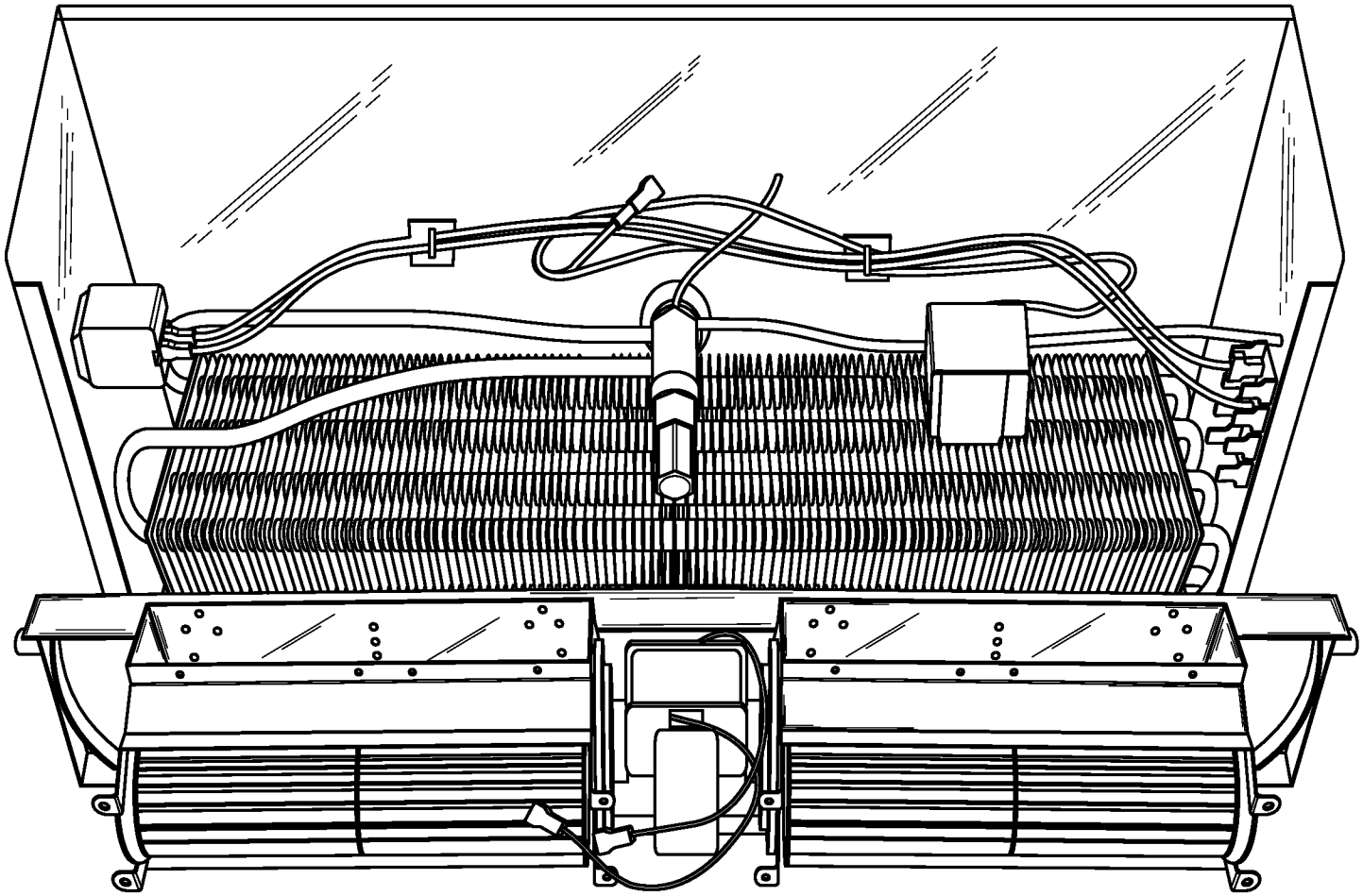
FIG. 14 depicts various parts of one embodiment of the invention.
Figure 15:
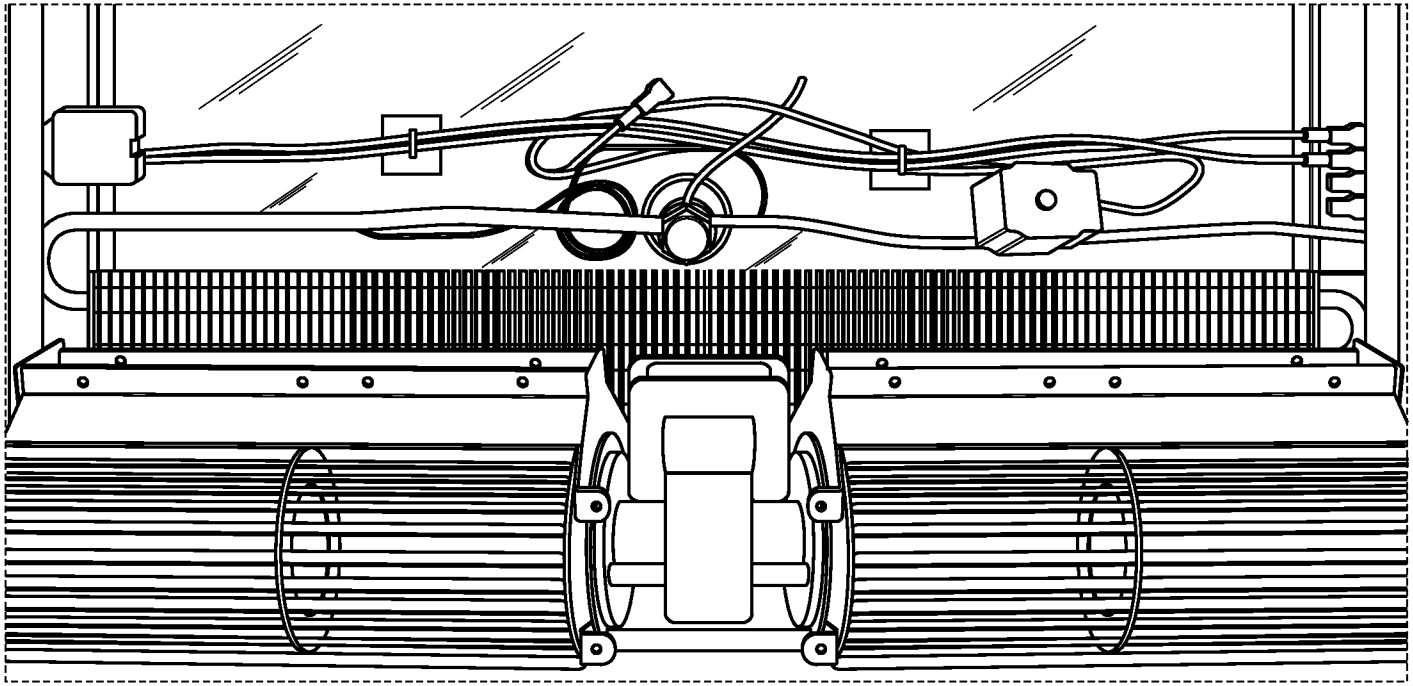
FIG. 15 depicts various parts of one embodiment of the invention.
Figure 16:
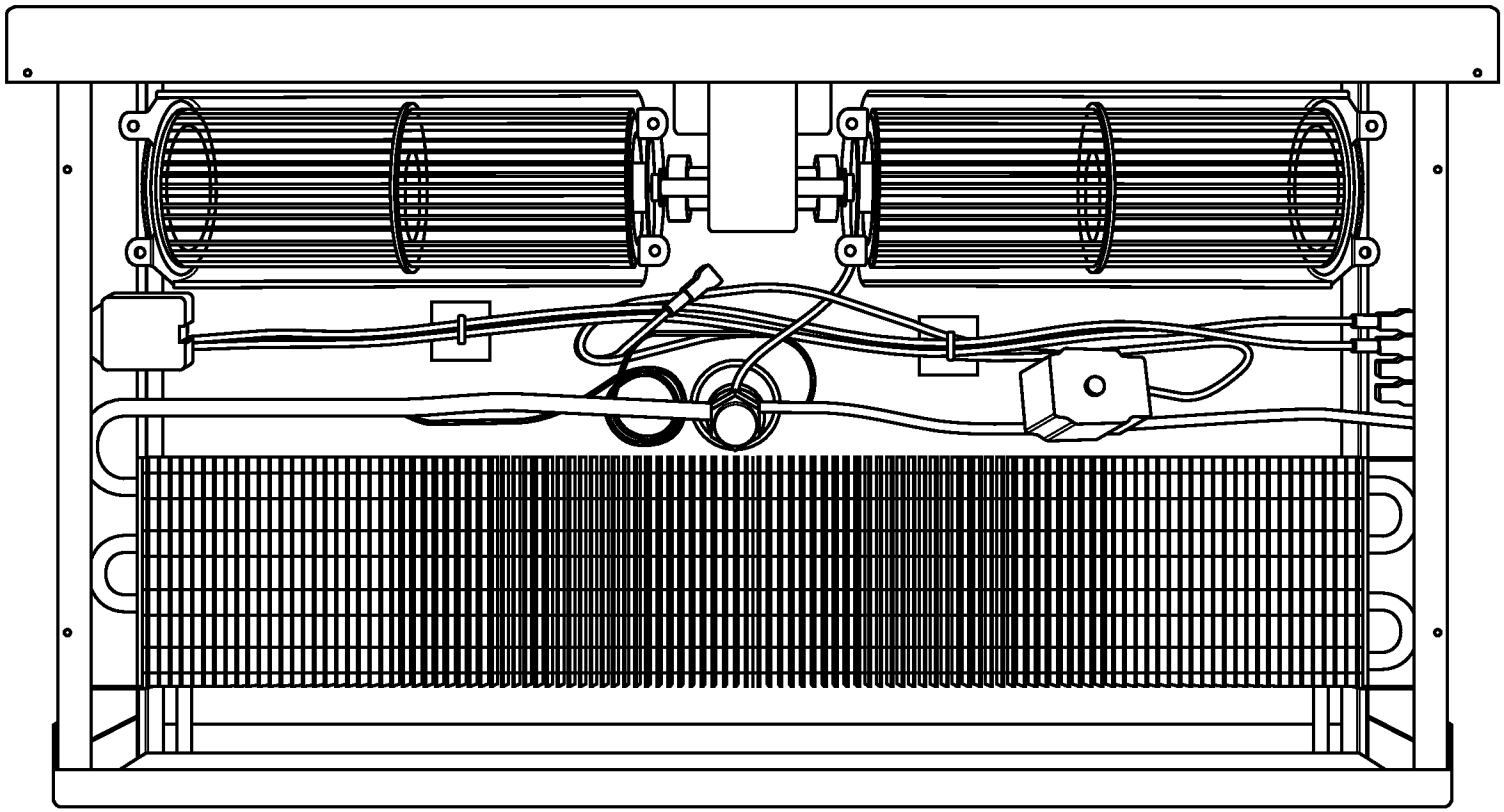
FIG. 16 depicts various parts of one embodiment of the invention.

FIG. 10 presents two cool air output vents adjacent to the two cross flow blowers.

FIGS. 11 to 16 depict various parts and aspects of a first embodiment.

Figure 17:
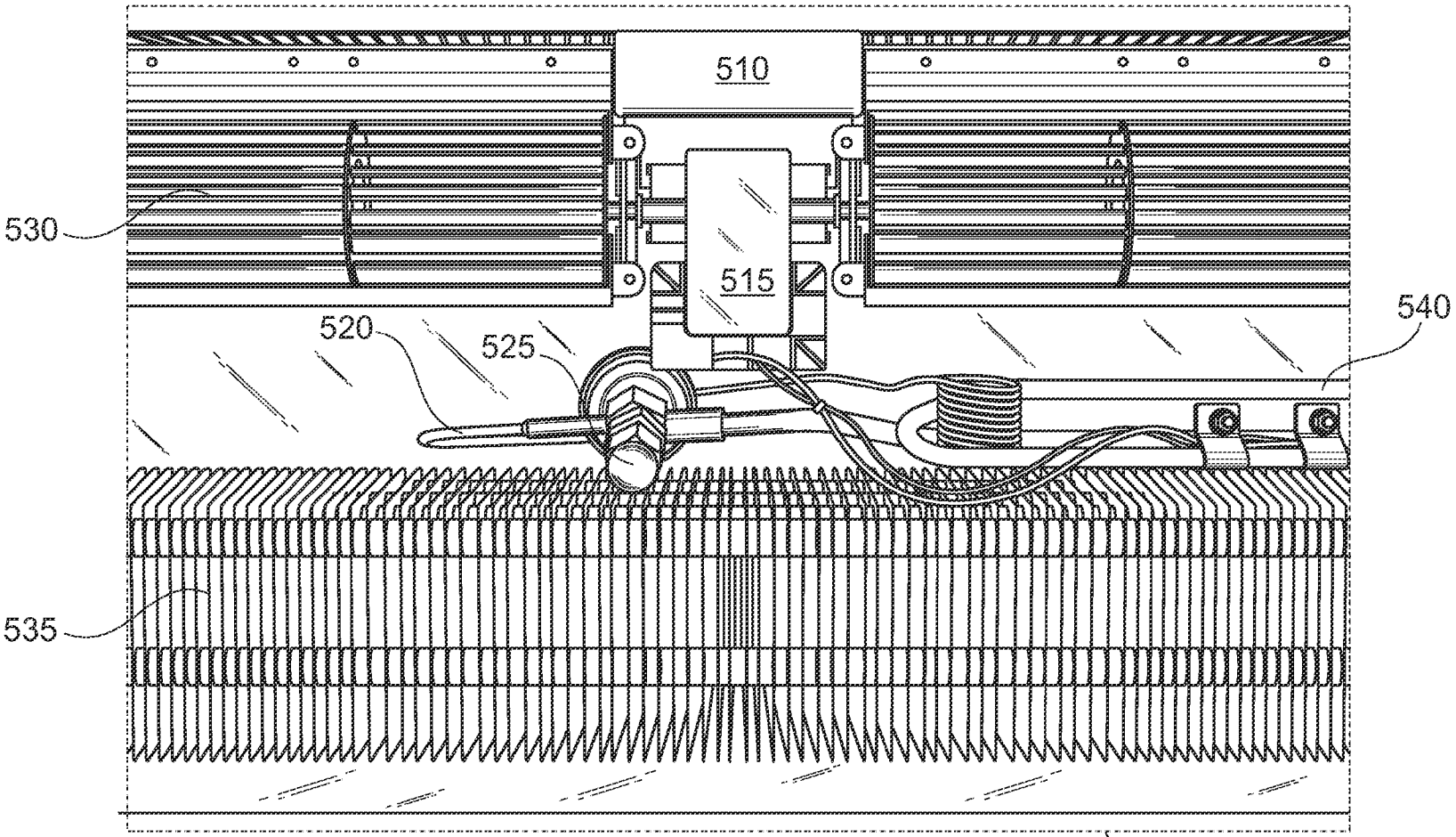
FIG. 17 depicts a second embodiment sometimes called a "Convertible and Compact Refrigeration System."

FIG. 17 depicts a second embodiment comprising a top plate 510, a condensation pan 500, a motor 515, a liquid line u bend 520, a TXV valve 525 one or more cross-flow blower wheels 530, a coated evaporator coil 535 and a sensing bulb 540.

Figure 18:
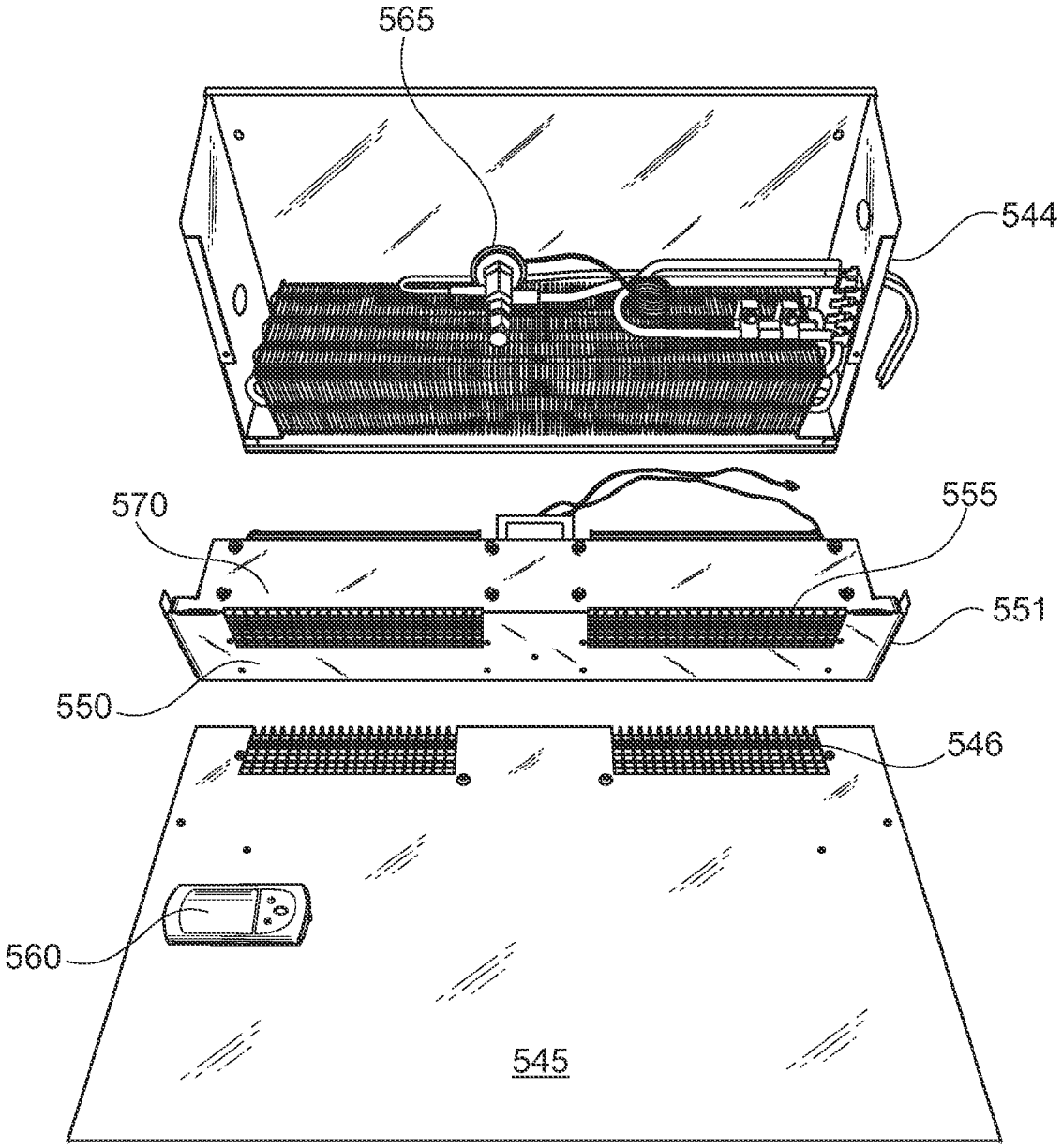
FIG. 18 depicts various components of a second embodiment

FIG. 18 depicts a lower housing 544, motor housing 551, the motor housing shown with a back plate 570, top plate 550 of motor housing and discharge vents 555 for top discharge. FIG. 18 also depicts a front discharge plate cover 545 having discharge vents 546 for side discharge. A digital control stat 560 is shown fastened to the front discharge plate cover 545.

Figure 19:
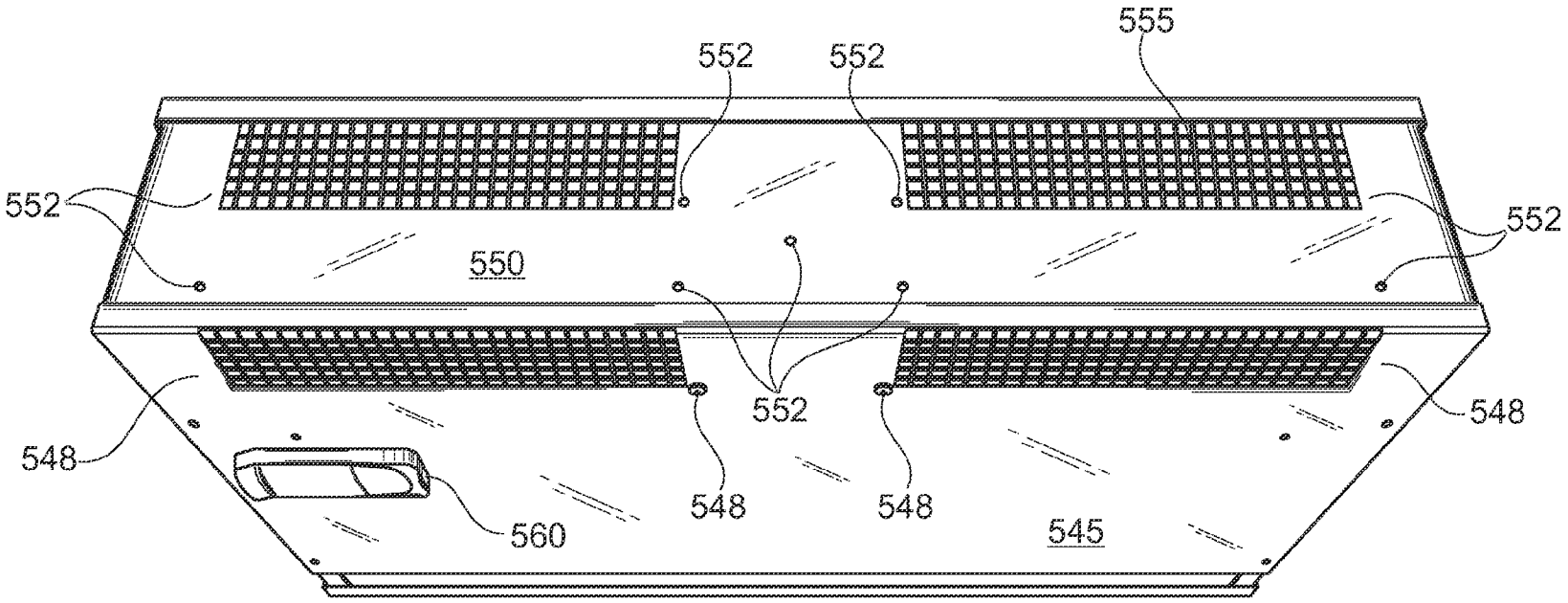
FIG. 19 depicts a second embodiment and top discharge plate in the foreground

FIG. 19 depicts a second embodiment in general 501. In the foreground a top plate 550 of the motor housing is shown with discharge vents 555 for top discharge of cooled air. The top plate 550 of the motor housing also has a plurality of fastener voids sometimes used to secure fastening clips on the fan and motor unit. In the background, FIG. 19 depicts a front discharge plate cover 545 comprising an attached digital control stat 560, a set of discharge vents 546 for side discharge and a plurality of fasteners securing a fan and motor unit in position for top discharge.

Figure 20:
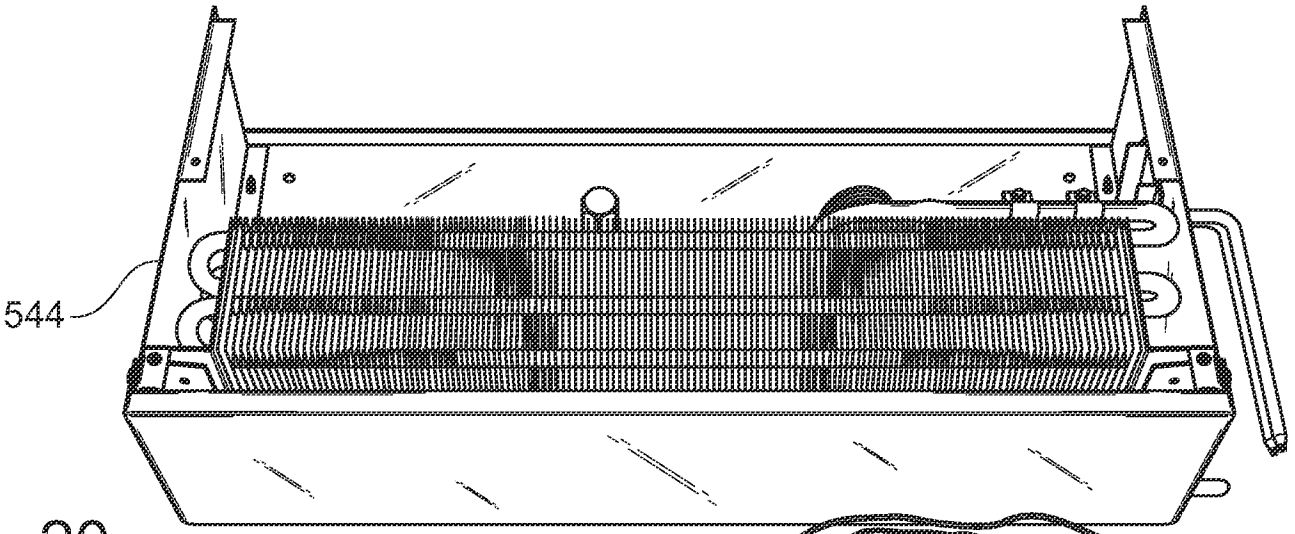
FIG. 20 depicts a lower housing unit of a second embodiment
Figure 21:
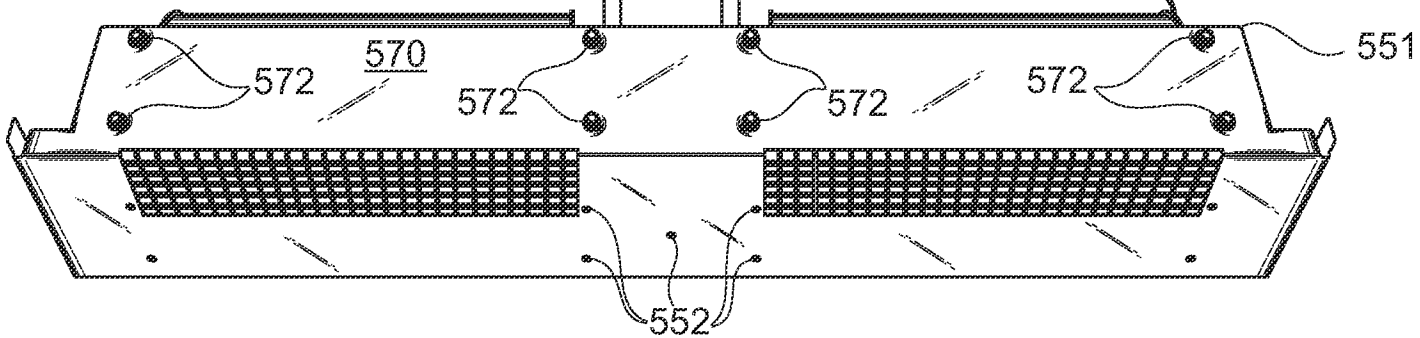
FIG. 21 depicts a motor housing unit of a second embodiment

FIG. 20 depicts lower housing unit detached from the motor housing 551 of FIG. 21.

FIG. 21 depicts a motor housing 551 having a back plate 570 with the back plate 570 shown with fasteners 572 securing a fan and motor unit in position for top discharge.

Figure 22:
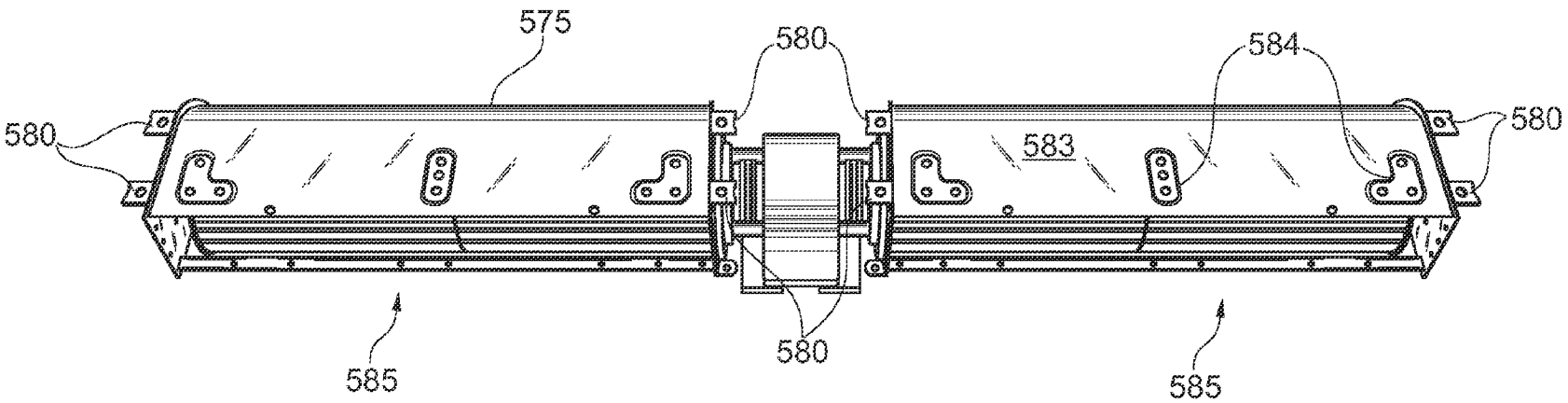
FIG. 22 depicts a fan and motor unit of a second embodiment

FIG. 22 depicts a free standing fan and motor unit 575 comprising a plurality of fastening clips 580, a fan cover 583, with the fan cover comprising fan cover voids 584. The fan and motor unit also comprises a motor fitted in between the fan covers 583. The fan covers 583 cover a pair of cross-flow bower wheels.

Figure 23:
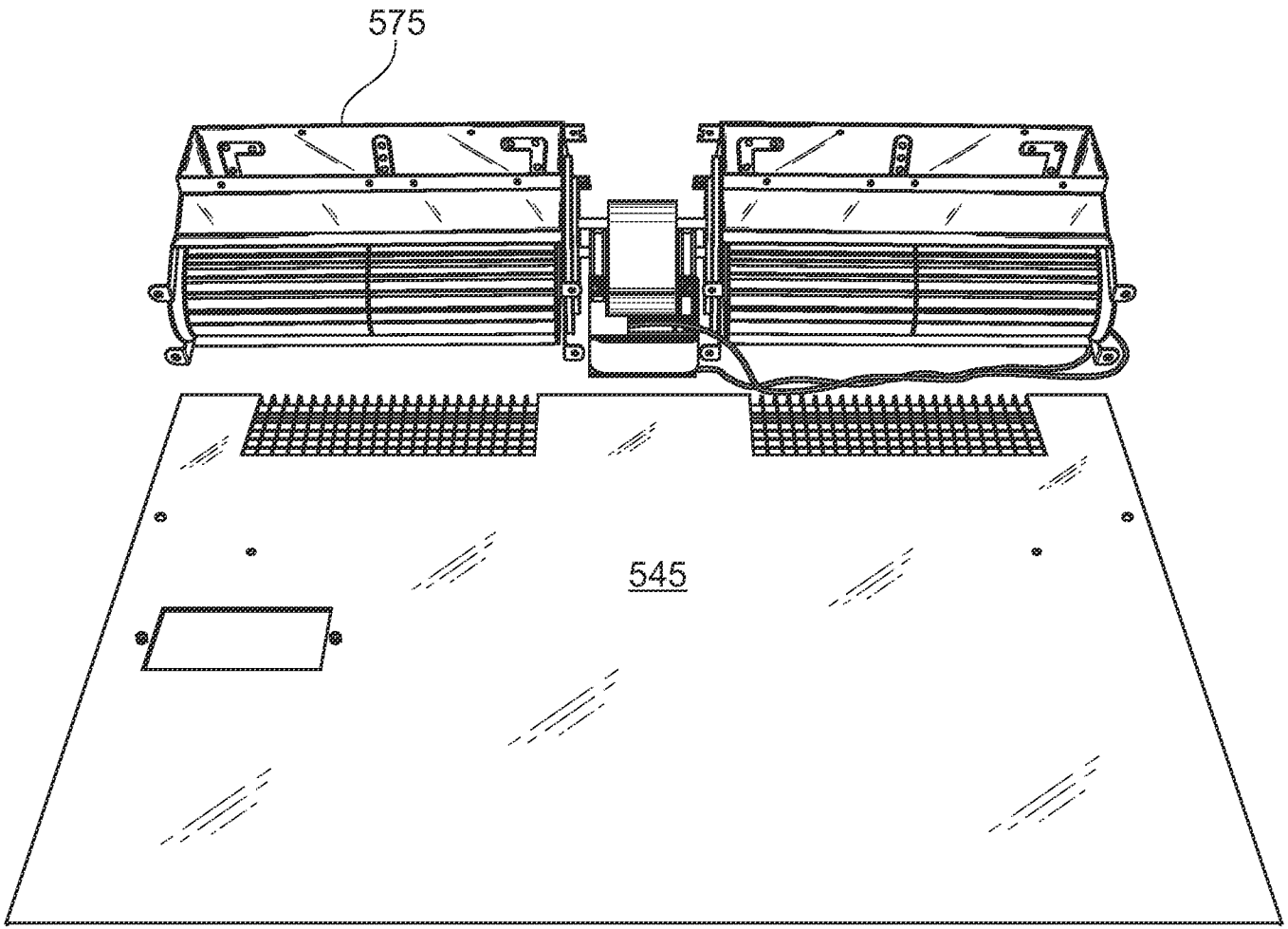
FIG. 23 depicts a front cover and a fan and motor unit of a second embodiment

FIG. 23 depicts a front discharge plate 545 in the foreground and a fan and motor unit in the background.

Figure 24:
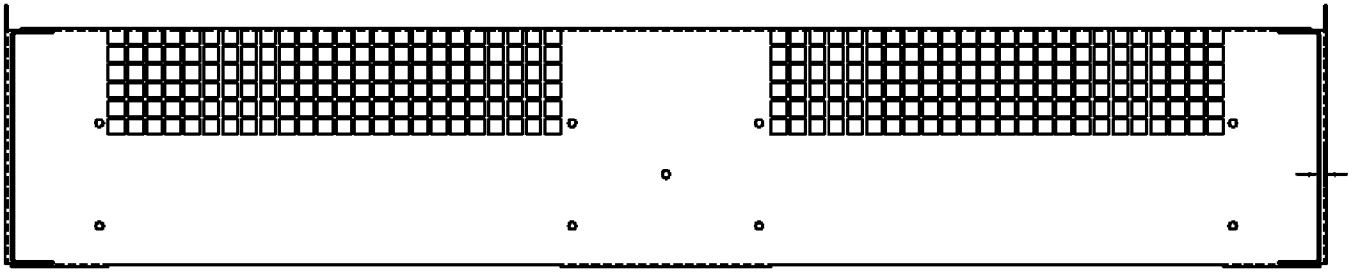
FIG. 24 depicts a plan view of a top plate of motor housing

FIG. 24 depicts a plan view of a top plate of a motor housing.

Figure 25:
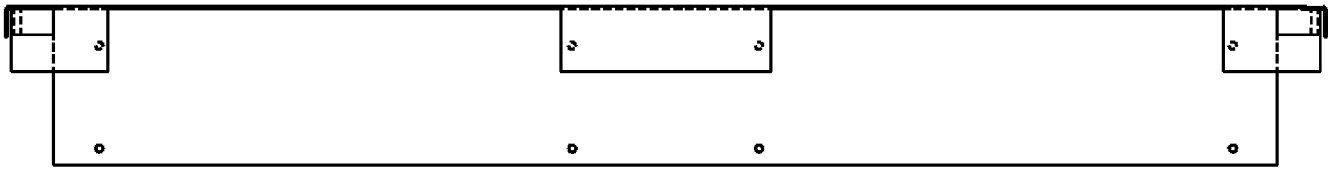
FIG. 25 depicts a plan view of a back plate

FIG. 25 depicts a plan view of a back plate.

When a fan and motor unit is secured to a back plate 570, the fans will force cooled air out of the top discharge vents. When a fan and motor unit is secured to top plate 550 of the motor housing, the fans will force cooled air out of the side discharge vents.

The configuration of the fan and motor unit 575 having a plurality of fastening clips 575 compatible with fastening voids upon both the back plate and the top plate of the motor housing, allow the second embodiment to be converted in the field for either top or side discharge. The back plate 570 may be secured in a perpendicular position from the top plate 550 of the motor housing.

Disclosed embodiments include the following items:

Item 1. A refrigeration system, convertible to top discharge or side discharge, the system comprising:

a) a fan and motor unit 575 comprising:

- i. two or more cross-flow blower wheels 530 attached to a motor 515, the cross-flow blower wheels attached to either side of the motor;
- ii. a fan cover 583 for each cross-flow blower wheel, the fan cover partially covering each cross-flow blower wheel;
- iii. a plurality of fastening clips 580
- iii. an air flow void 585 defined by edges of the fan cover;

b) a motor housing 551 comprising:

i. a top plate 550 comprising top discharge vents 555 and a plurality of fastener voids complementary to the plurality of fastening clips;

ii. a back plate 570 attached to the top plate 550 at an angle between 75 and 115 degrees, the back plate comprising a plurality of fastener voids 572 complementary to the plurality of fastening clips; and c) a front discharge plate cover 545 attached to the top plate 550, the front discharge plate cover comprising a plurality of side discharge vents 546.

Item 2. The system of item 1 further comprising:

a) a lower housing 544 connected to the front discharge plate and the lower housing comprising a condensation pan 500, a liquid line u bend 520, a TXV valve 525, a coated evaporation coil, a sensing bulb 540, a digital control stat 560, and a power head 565.

Item 3. The system of item 1 wherein the plurality of fastening clips 580 of the fan and motor unit are attached to the fastener voids 552 within the top plate 550 of the motor housing 551.

Item 4. The system of item 1 wherein the plurality of fastening clips 580 of the fan and motor unit are attached to the fastener voids 572 of the back plate 570.

Item 5. The system of item 1 wherein the plurality of fastening clips 580 surround each cross-flow blower wheel.

Item 6. The system of item 1 wherein the digital control stat is attached to the front discharge plate cover.

Item 7. A rotational plate attached to the motor, the rotational plate having one or more air channels.

What is claimed is:

1. A refrigeration system, convertible to top discharge or side discharge, the system comprising: a) a fan and motor unit comprising:

i. one or more cross-flow blower wheels independently attached to the motor, the cross-flow blower wheels attached to either side of the motor;

ii. a fan cover for each cross-flow blower wheel, the fan cover partially covering each cross-flow blower wheel; the fan cover having four edges, the four edges terminating on same plane defining a flow void; the fan cover rotatable to align the air flow void to either a top discharge vent or a side discharge vent, the fan cover attached to a plurality of fastening clips; the fan cover capable of being independently oriented to direct cooled air through the top discharge vent or the side discharge vent;

b) a motor housing comprising:

i. a top plate comprising top discharge vents and a plurality of fastener voids complementary to the plurality of fastening clips;

ii. a back plate attached to the top plate at an angle between 75 and 115 degrees, the back plate comprising a plurality of fastener voids complementary to the plurality of fastening clips;

c) a front discharge plate cover attached to the top plate, the front discharge plate cover comprising a plurality of side discharge vents;

d) a lower housing connected to the front discharge plate cover and the lower housing comprising a condensation pan, a liquid line U-bend, a TXV valve, a coated evaporator coil, a sensing bulb, a digital control stat, and a power head; and e) the plurality of fastening clips of the fan and motor unit are attached to the fastener voids within the top plate of the motor housing or the front discharge plate of the motor housing.

2. The system of claim 1 wherein the plurality of fastening clips of the fan and motor unit are attached to the fastener voids of the back plate.

3. The system of claim 1 wherein the plurality of fastening clips surrounds each cross-flow blower wheel.

4. The system of claim 1 wherein the digital control stat is attached to the front discharge plate cover.

* * * * *